US006256006B1

(12) United States Patent
Yamamoto et al.

(10) Patent No.: US 6,256,006 B1
(45) **Date of Patent: *Jul. 3, 2001**

(54) LIQUID CRYSTAL DISPLAY WITH TEMPERATURE DETECTION TO CONTROL DATA RENEWAL

(75) Inventors: Kiyoshi Yamamoto; Shoji Kamasako, both of Tokyo (JP)

(73) Assignee: Asahi Kogaku Kogyo Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/791,847

(22) Filed: Jan. 30, 1997

(30) Foreign Application Priority Data

Feb. 1, 1996 (JP) ..... 8-016636
Feb. 7, 1996 (JP) ..... 8-021466

(51) Int. Cl.[7] ..... G09G 3/36
(52) U.S. Cl. ..... 345/101; 345/94
(58) Field of Search ..... 345/101, 89, 94, 345/99, 98; 349/72

(56) References Cited

U.S. PATENT DOCUMENTS 3,907,405 * 9/1975 Fukai et al. ..... 345/101
4,338,600 * 7/1982 Leach ..... 345/101
4,370,647 * 1/1983 Brantingham ..... 345/94
4,745,403 * 5/1988 Tamura ..... 345/101
4,923,285 * 5/1990 Ogino et al. ..... 345/101
5,029,982 * 7/1991 Nash ..... 345/101
5,033,822 * 7/1991 Ooki et al. ..... 345/101
5,216,480 * 6/1993 Kaneko et al. ..... 356/152
5,313,225 5/1994 Miyadera ..... 345/102
5,398,042 * 3/1995 Hughes ..... 345/94
5,608,422 * 3/1997 Ikeda ..... 345/110
5,796,381 * 8/1998 Iwasaki et al. ..... 345/101
5,825,344 * 10/1998 Hughes et al. ..... 345/101
5,886,678 * 3/1999 Katakura et al. ..... 345/94
5,936,604 * 8/1999 Endou ..... 345/101

OTHER PUBLICATIONS

Nikon, "Field Station DTM–700 Series DTM–750/730/720 MSDOS Compatible Open System and Field Computer Integration Realizes True Total Station®", Dec. 1993.

* cited by examiner

*Primary Examiner*—Steven Saras
*Assistant Examiner*—Paul A. Bell
(74) *Attorney, Agent, or Firm*—Greenblum & Bernstein, P.L.C.

(57) ABSTRACT

A liquid crystal display apparatus includes a liquid crystal display panel which indicates information represented by a contrast of the segments of the liquid crystal display when a drive voltage is applied to the display. A temperature meter measures the temperature of the LCD panel and the ambient temperature. A drive voltage setting device sets the drive voltage to be voltage to be applied to the LCD panel so as to maintain a constant contrast in accordance with the temperature value measured by the temperature meter. A drive voltage supply supplies the drive voltage set by the drive voltage setting device to the LCD panel.

17 Claims, 10 Drawing Sheets

LIQUID CRYSTAL DISPLAY WITH TEMPERATURE DETECTION TO CONTROL DATA RENEWAL

BACKGROUND OF THE INVENTION

1. Field of the Invention

The present invention relates to a liquid crystal display (LCD) used in a surveying instrument or the like. In particular, the present invention relates to an LCD in which information can be displayed while maintaining the contrast of an LCD plate regardless of the ambient temperature of the LCD plate, and also relates to an LCD in which information can be certainly indicated regardless of the ambient temperature of the LCD plate.

2. Description of the Related Art

Since LCD's can be made light and thin and have low power consumption, they have been used in various information indicating apparatuses. For instance, in surveying instruments, such as a light wave distance-measuring meter or an electronic theodolite, an LCD is used to indicate operation instructions or measurements to an operator.

A plate of the LCD is composed of a glass substrate which includes a liquid crystal enclosed therein. When the polarization state of light passing through the liquid crystal changes, the LCD plate selectively permits light to pass therethrough or interrupts light to indicate information as the contrast of the light which is represented by darkness or brightness of the segments.

Surveying instruments are generally used outdoors where the possibility of a large change in temperature exists thus resulting in the possibility that the characters on the LCD become difficult to read.

SUMMARY OF THE INVENTION

It is an object of the present invention to provide a liquid crystal display (LCD) in which the contrast of the indication of information can be kept constant regardless of the ambient temperature. Another object of the present invention is to provide a liquid crystal display in which information can be certainly indicated based on indication data, regardless of the ambient temperature of the LCD.

To achieve the objects mentioned above, according to an aspect of the present invention, there is provided a liquid crystal display having a liquid crystal display panel which indicates information represented by a contrast of light when a drive voltage is applied thereto. A temperature measuring device measures the temperature of the LCD panel or the ambient temperature. A drive voltage setting device sets the drive voltage to be applied to the LCD panel so as to keep the contrast constant, in accordance with the temperature value measured by the temperature measuring device.

Preferably, a drive voltage supply is provided for supplying the drive voltage set by the drive voltage setting device to the LCD panel.

The liquid crystal display plate can be of a TN (twisted nematic) type. The drive system of the LCD plate can be either a static type in which the shape of the electrodes corresponds to the shape of the segments which represent information, or a matrix drive type in which the information is indicated by a plurality of dots (segments) corresponding to the electrodes in a matrix arrangement. In the latter type, a TFT (thin-film transistor) type can be used. Also, the LCD plate can be constructed so that the light passes through only the segments to which the drive voltage is applied or only the segments to which no drive voltage is applied.

The temperature measuring device can be brought into direct contact with the LCD plate or can be slightly spaced from the LCD plate. The temperature measuring device can be of a type in which the ambient temperature of the LCD plate is measured or a type in which the conduction heat from the LCD plate is measured. The temperature measuring device can consist of a thermistor or thermocouple, etc.

The relationship between the ambient temperature and the drive voltage to maintain a constant contrast of the indication can be held as a function in the drive voltage setting means. Alternatively, a table which shows the sampled values of the ambient temperature and corresponding drive voltages can be stored in the drive voltage setting device.

An indication data renewal device can vary the interval of renewal of the indication data linearly or stepwise, with respect to the ambient temperature. In the former case, the indication data renewal device can hold an arithmetic function which represents the relationship between the ambient temperature and the renewal interval or can store a table which shows the relationship between sampled values of the ambient temperature and the renewal interval. Preferably, the renewal interval is set to be slightly longer than the indication response time at the corresponding ambient temperature, so that the renewal speed of the indication can be kept relatively high.

According to another aspect of the present invention a liquid crystal display is provided having a liquid crystal display panel which indicates information when a drive voltage is applied thereto. A temperature measuring device measures a temperature of the liquid crystal display panel or an ambient temperature thereof. A drive voltage setting device sets the drive voltage to be applied to the liquid crystal display panel so as to maintain a contrast of the liquid crystal display panel constant, in accordance with a value of the temperature measured by the temperature measuring device.

According to yet another aspect of the present invention, a liquid crystal display is provided having a liquid crystal display panel. An indication control device controls an indication of information on the liquid crystal display panel based on indication data. A temperature measuring device measures a temperature of the liquid crystal display panel or an ambient temperature of the liquid crystal display panel. An indication data renewal device renews the indication data at a time interval corresponding to the ambient temperature measured by the temperature measuring device.

The present disclosure relates to subject matter contained in Japanese Patent Application Nos. 08-16636 (filed on Feb. 1, 1996) and 08-21466 (filed on Feb. 7, 1996) and which are expressly incorporated herein by reference in their entireties.

BRIEF DESCRIPTION OF THE DRAWINGS

The invention will be described below in detail with reference to the accompanying drawings, in which.

DESCRIPTION OF THE PREFERRED EMBODIMENTS

The following discussion will be addressed to an embodiment in which a liquid crystal display according to the present invention is applied to a total station surveying apparatus.

An LCD plate of the LCD is composed of a glass substrate which includes a liquid crystal enclosed therein and which is provided on the surfaces with electrodes which constitute segments or dots. When a drive voltage is selectively applied to the electrodes, the polarization state of light passing through the liquid crystal changes (i.e., the direction of the linearly polarized light is turned), so that the LCD plate selectively permits light to pass therethrough or interrupts light to indicate information as the contrast of the light which is represented by darkness or brightness of the segments.

The relationship between the drive voltage applied to the electrodes and the change in the polarization state of the light passing through the liquid crystal (i.e., the angular displacement of the direction of the linearly polarized light) varies in accordance with a parameter such as temperature; due to the inherent characteristics of the liquid crystal. Consequently, if the drive voltage is constant, the contrast of the information indicated on the LCD plate (contrast of indication) varies in accordance with the temperature of the LCD plate.

Therefore, if the drive voltage of the LCD plate is set such that an appropriate contrast is obtained at, for example, 20° C., the contrast is too high or too low at a higher or lower temperature, respectively.

The first embodiment of the present invention is characterized in that even if there is a change in temperature in the area around the surveying apparatus the contrast of the LCD is certainly maintained.

<Outline of Total Station>

Figure 1:
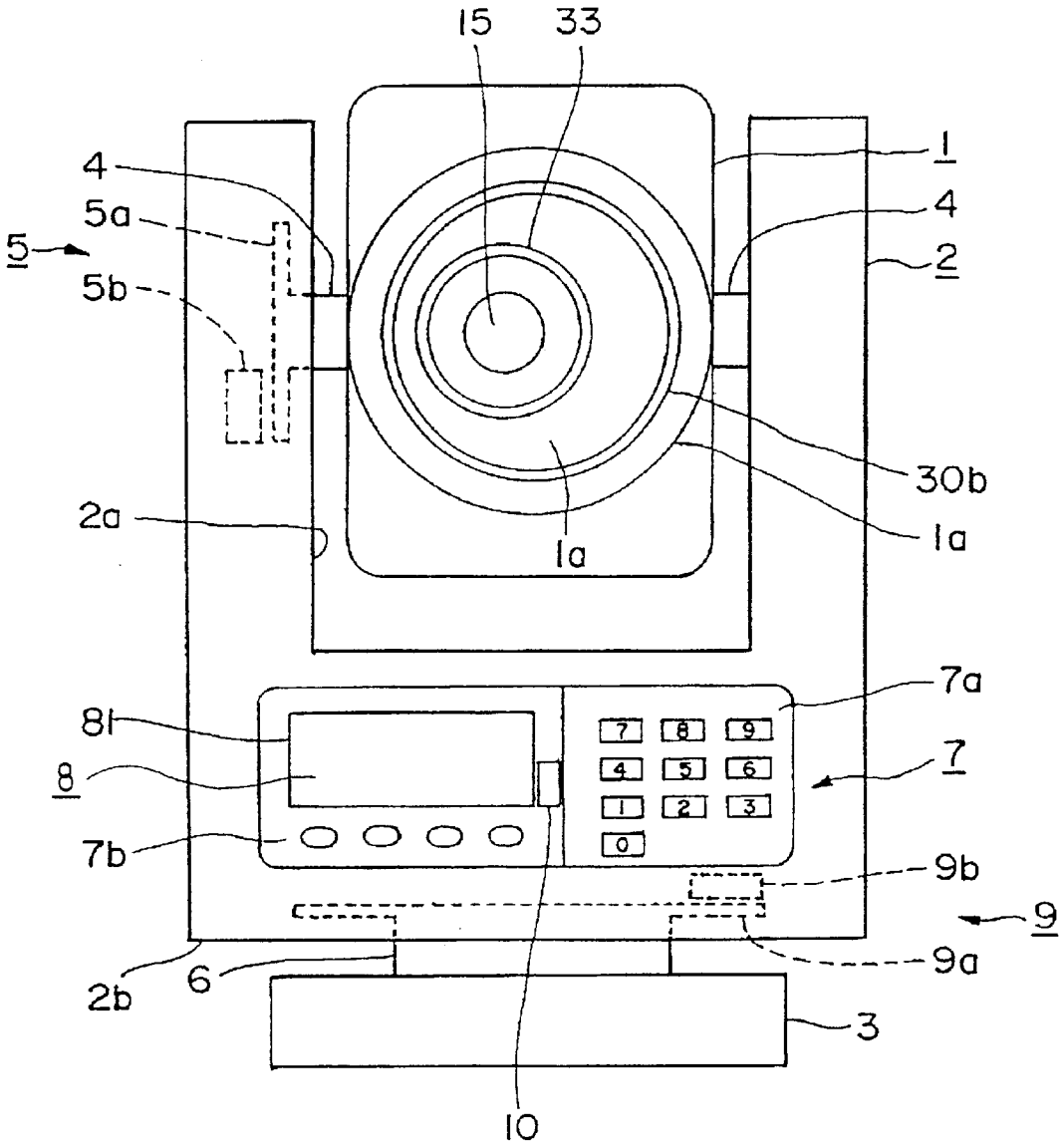
FIG. 1 is a front elevational view of a surveying apparatus to which the present invention is applied.

FIG. 1 shows a front elevational view of a total station. In FIG. 1, the total station essentially consists of a collimating telescope portion 1, a support 2, and a base portion 3.

The support 2 is substantially U-shaped as viewed in FIG. 1 and is provided on the front surface thereof with an LCD (liquid crystal display) panel (plate) 81 which constitutes a display (indicator) portion 8, a temperature measuring portion 10 provided on one side of the LCD panel 81, and an operation portion 7 having a number of input keys. The LCD panel (plate) 81 is made of a TN (Twisted Nematic) type liquid crystal. A color or gray scale LCD panel can be used in the present invention.

The temperature measuring portion 10 which constitutes a temperature measuring device consists of a temperature sensor which measures the ambient temperature of the LCD panel 81. The temperature sensor is in the form of a thermistor or thermocouple which is adhered to the support 2 by means of a set resin.

The operation portion 7 is in the form of an interface to input various data or operation instruction commands. The interface consists of a number of input keys which are grouped into numeral keys 7*a* and function keys 7*b*. The numeral keys 7*a* are adapted to input numerical data necessary for a surveying operation. Different functions for each mode (initialization mode, distance measuring mode, angle measuring mode, correction mode, etc.), set in the total station, are allotted to the function keys 7*b*.

The LCD panel 81 can be provided on the rear surface thereof with a light emitter (back light). It is also possible for the temperature measuring portion 10 to measure the temperature of the LCD panel 81 instead of the ambient temperature.

The collimating telescope portion 1 is in the form of a generally square-prism whose longitudinal axis extends in the direction of an optical axis (perpendicular to the sheet of the drawings) of the collimating telescope portion 1 and is located in a substantially U-shaped recess 2*a* of the support 2. The collimating telescope portion 1 is provided with a collimating telescope to collimate the direction thereof to an object whose distance is to be measured or an object whose angle is to be measured, a light emitter which emits modulated light through an objective lens of the collimating telescope, a light receiver which receives the modulated light reflected by a corner cube located at the point to be surveyed, and a phase difference detecting apparatus which detects the phase difference between the modulated light upon emission and the modulated light upon receipt.

A stationary barrel 1*a*, a focusing ring 30*b*, a diopter adjusting ring 33, and an eyepiece system 15 are also provided as shown in FIG. 1.

The collimating telescope portion 1 is supported in the substantially U-shaped recess 2*a* by a shaft 4 so as to rotate in a vertical plane perpendicular to the sheet of the drawings. The shaft 4 is provided at one end with a transparent scale 5*a* in the form of a circular disc. The support 2 is provided with a first detector 5*b* to read a pattern provided on the transparent scale 5*a*. The transparent scale 5*a* and the detector 5*b* constitute an incremental type vertical direction encoder 5 which generates pulses, the number of which corresponds to the relative angular displacement of the collimating telescope portion 1 and the support 2 to represent the direction of the relative rotation.

The base portion 3 which is in the form of a circular cylinder, is supported at a bottom surface 2*b* of the support 2 by a shaft 6 whose axis extends in a direction perpendicular to the axis of the shaft 4 so as to relatively rotate in a horizontal plane as viewed in FIG. 1. The shaft 6 is provided at one end with a transparent scale 9*a* in the form of a circular disc. The support 2 is provided with a second detector 9*b* which reads a pattern provided on the transparent scale 9*a*. The transparent scale 9*a* and the detector 9*b* constitute an incremental type horizontal direction encoder 9 which generates pulses, the number of which corresponds to the relative angular displacement of the base portion 3 and the support 2 to represent the direction of the relative rotation.

Thus, the collimating telescope portion 1 can be oriented in any direction through the base portion 3 which is attached to a tripod positioned on the ground. The altitude angle and the azimuth angle of the collimating telescope are measured in accordance with the pulses generated from the vertical encoder 5 and the horizontal encoder 9. The distance from the corner cube located on the axis of the collimating telescope is measured in accordance with the phase difference of the modulated light transmitted through the objective lens (not shown) of the collimating telescope.

<Internal Circuit of Total Station>

Figure 2:
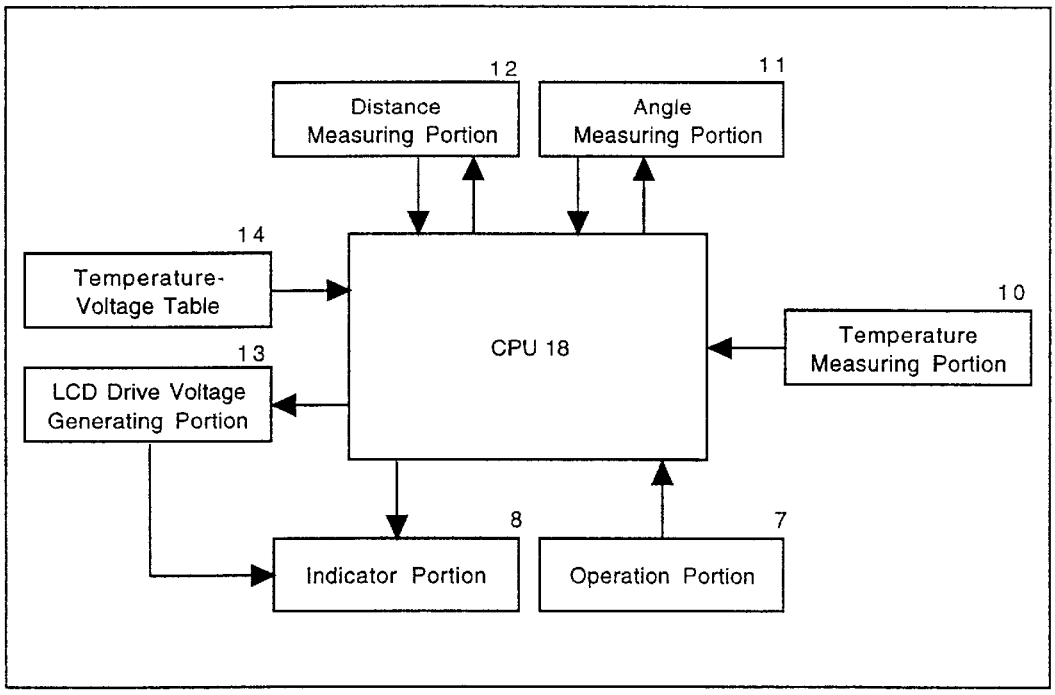
FIG. 2 is a block diagram of an internal circuit of the surveying apparatus shown in FIG. 1.

The internal structure of the total station will be discussed below. In the block diagram shown in FIG. 2, the operation portion 7, the indication portion (display portion) 8, the temperature measuring portion 10, an angle measuring portion 11, a distance measuring portion 12, an LCD drive voltage generating portion 13, and a temperature-voltage table 14 are connected to a CPU (central processing unit) 18.

The distance measuring portion 12 consists of a circuit block which functions as a light wave measuring meter (distance measuring apparatus). Namely, the distance measuring portion 12 corresponds to the light emitter, the light receiver, and the phase difference detecting apparatus, incorporated in the collimating telescope portion 1, and inputs the phase difference data detected by the phase difference detecting apparatus into the CPU 18.

The angle measuring portion 11 consists of a circuit block which functions as an electronic theodolite (angle meter). Namely, the angle measuring portion 11 corresponds to the vertical encoder 5 and the horizontal encoder 9, shown in FIG. 1, and inputs the pulses generated during the rotation of the collimating telescope portion 1 in the vertical and horizontal directions into the CPU 18.

The LCD drive voltage generating portion 13 which constitutes a drive voltage supply device generates the voltage to be supplied to the LCD panel 18, i.e., the LCD drive voltage which is supplied to the indicator portion 8.

The CPU 18 performs control programs to control the whole operation of the total station to calculate the distance and angle in accordance with the phase difference data from the distance measuring portion 12 and the pulses from the angle measuring portion 11. The CPU 18 produces the indication data (distance data based on the distance value or angle data based on the angle value, etc.), in accordance with the indication commands of the various operations obtained by carrying out the control program or the calculated distance value or angle value. The indication data is sent to the indicator portion 8. The CPU 18 determines the LCD drive voltage necessary to indicate the information while keeping the contrast of the LCD panel 81 constant and commands the LCD drive voltage generating portion 13 to produce the LCD drive voltage determined by the CPU 18 (LCD drive voltage setting means). The CPU 18 determines the LCD drive voltage, with reference to the temperature-voltage table 14, in accordance with the ambient temperature of the LCD panel 81 input by the temperature measuring portion 10 (drive voltage reading means).

Figure 3:
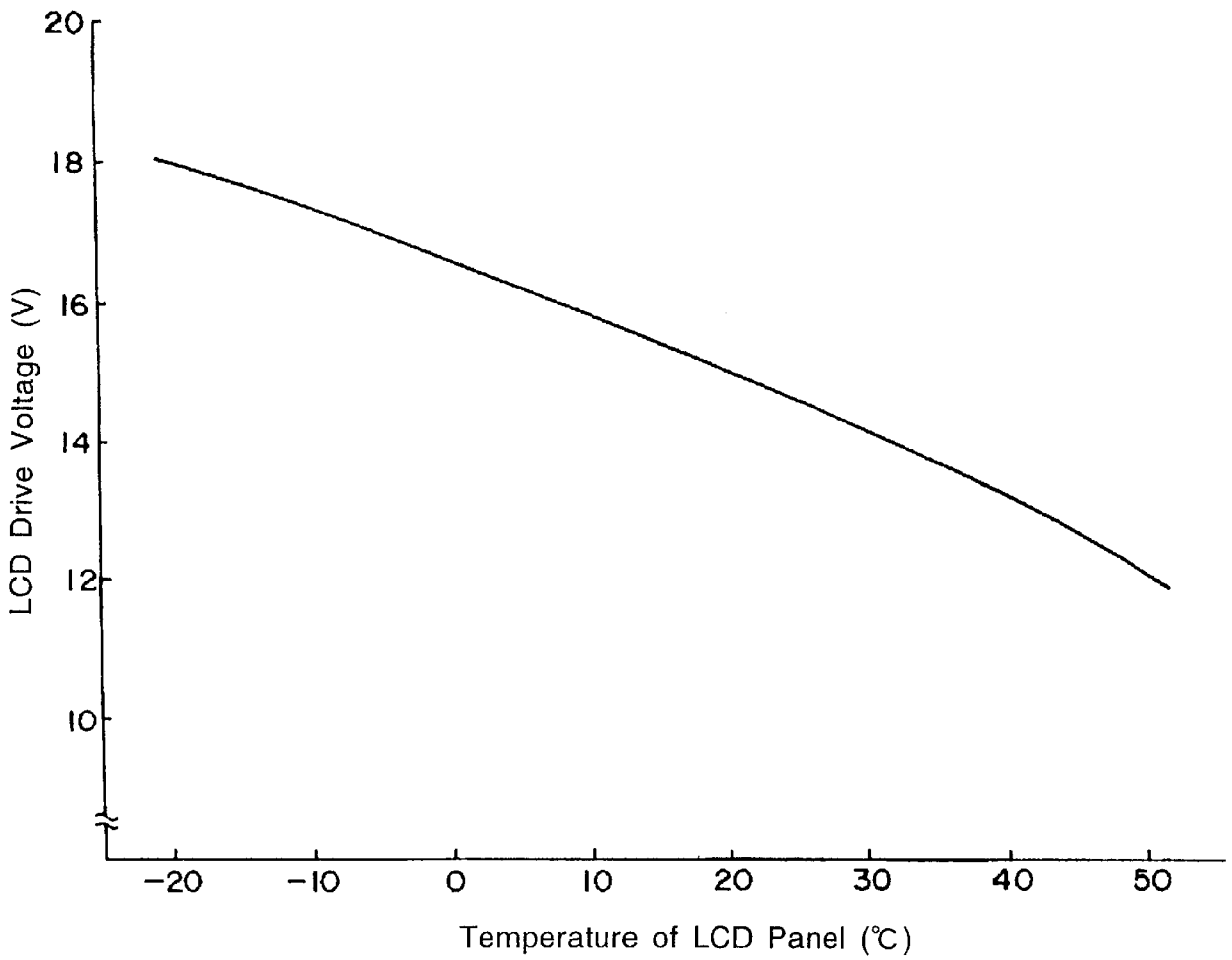
FIG. 3 is a graph which represents the relationship between the ambient temperature and the LCD drive voltage shown in a temperature-voltage table.

In the temperature-drive voltage table 14, the LCD drive voltages necessary to keep the contrast of the LCD panel 81 constant are written at entries corresponding to addresses represented by the digital values of the ambient temperature through an A/D converter. The relationship between the ambient temperature of the LCD panel 81 and the LCD drive voltage shown in the temperature-drive voltage table 14 is shown in FIG. 3. In practice, the LCD drive voltages to be written at the respective entries (addresses) of the temperature-voltage table 14 are set in accordance with the temperature-voltage curve which is experimentally obtained.

Figure 4:
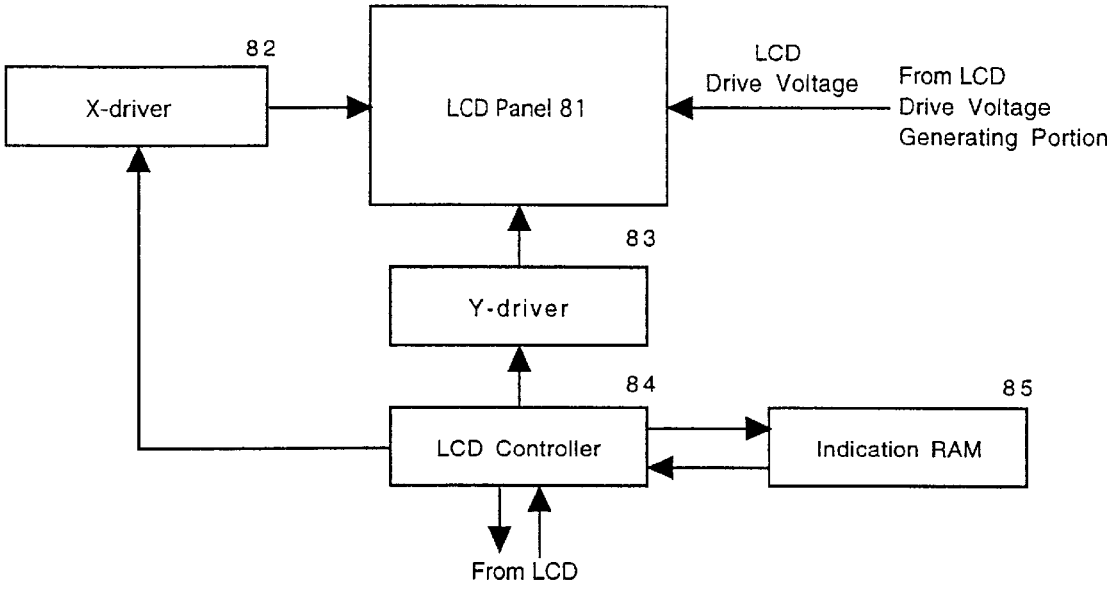
FIG. 4 is a block diagram of a display portion shown in FIG. 2.

The indicator portion 8 indicates the functions allotted to the function keys 7*b*, the distance and angle values calculated by the CPU 18, and other information in the LCD panel 81 shown in FIG. 1. The indicator portion 8 consists of the LCD panel 81, an X-driver 82 and a Y-driver 83, an LCD controller 84 connected to the drivers 82, 83 and the CPU 18, and an indication RAM 85 connected to the LCD controller 84, as shown in FIG. 4.

The LCD panel 81 is driven by a TFT type liquid crystal plate which consists of a liquid crystal cell having a glass substrate in which a liquid crystal is enclosed, power electrodes in a matrix arrangement on one side surface of the liquid crystal cell, earth electrodes in a matrix arrangement on the other side surface of the liquid crystal cell. The LCD drive voltage is supplied to each of the terminals of the power electrodes and the earth potential (i.e., ground) is supplied to each of the terminals of the earth electrodes through switching transistors arranged in the X and Y directions. Consequently, when the transistors are turned ON, potential occurs between the earth electrodes and the power electrodes, connected to the associated switching transistors, so that the orientation of the corresponding liquid crystal molecules changes, such that the polarization direction of the linearly polarized light passing therethrough is turned (the polarization direction is turned by a maximum of 90°). Consequently, the light is interrupted by the polarization element adhered to the surface of the glass substrate. The interruption of the light causes the appearance of a dark shadow portion.

The indication RAM 85 stores the indication data sent from the CPU 18. The LCD controller 84 controls the entirety of the indicator portion 8. Namely, when the indication data is supplied from the CPU 18, the indication data is stored in the indication RAM 85 and the stored indication data is successively read therefrom until subsequent indication data is sent, so that the X-driver 82 and the Y-driver 83 can be controlled in accordance with the indication data read. That is, the LCD controller 84 successively reads pixel data which constitutes the indication data stored in the indication RAM 85. When the indication of the read pixel data is black, the positions of the pixels are specified in the indication. The positional data of the specified pixels in the X and Y directions is sent to the X-driver 82 and Y-driver 83, respectively.

The X-driver 82 and the Y-driver 83 selectively turn ON the switching transistors in the LCD panel 81 in accordance with the control by the LCD controller 84. Namely, the X-driver 82 specifies the switching transistors to be turned ON in the X direction in accordance with the data sent from the LCD controller 84, and the Y-driver 83 specifies the switching transistors to be turned ON in the Y direction in accordance with the data sent from the LCD controller 84, respectively. Consequently, only one switching transistor specified by the drivers 82 and 83 is turned ON. Thus, when the switching transistors in the X and Y directions, corresponding to the pixels whose indication color is black, are successively turned ON, the image (information) corresponding to the indication data is indicated in the LCD panel 81.

<Indication Operation>

The operation carried out by the CPU 18 to indicate the information in the LCD panel 81 of the indicator portion 8 will be discussed below with reference to the flow chart shown in FIG. 5.

Figure 5:
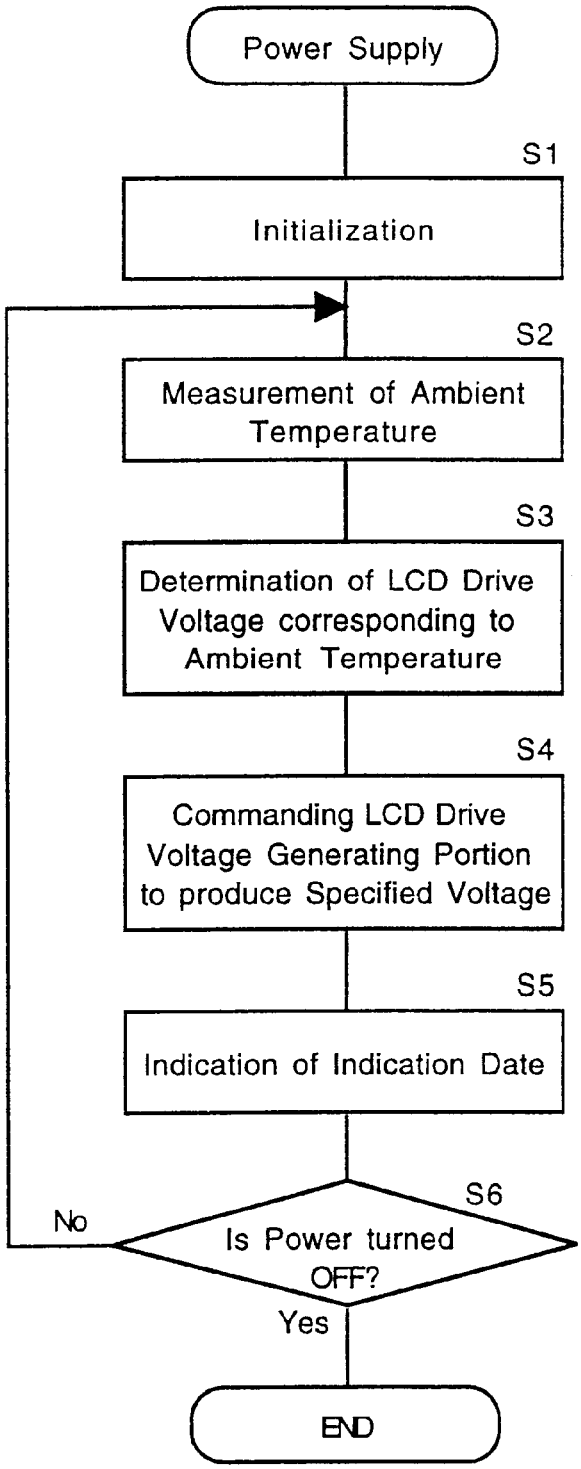
FIG. 5 is a flow chart showing indication operations carried out in a central processing unit shown in FIG. 2.

The operation shown in the flow chart in FIG. 5 commences when power is supplied to the total station. The initialization operation is carried out at step S1. Thereafter, the ambient temperature of the LCD panel 81 measured by the temperature measuring portion 10 is converted to a digital value by an A/D converter and is read at step S2. At step S3, the temperature-voltage table 14 is retrieved using the address representing the digital value of the ambient temperature to obtain the corresponding LCD drive voltage written in the table.

Thereafter at step S4, the CPU commands the LCD drive voltage generating portion 13 to produce the LCD drive voltage determined at step S3. Consequently, the LCD drive voltage corresponding to the ambient temperature necessary to indicate the information while maintaining the contrast is supplied to the indicator portion 8.

The indication data is sent to the LCD controller 84 of the indicator portion 8 at step S5. Consequently, the indicator portion 8 indicates the information corresponding to the indication data.

At step S6, whether the power of the total station is ON or OFF is checked. If the power is ON, the control is returned to step S1 to perform the control operation in accordance with the latest ambient temperature. If the power is OFF, the indication operation ends.

<Mode of Operation>

To measure the angle and distance using the total station constructed as above, an operator turns the power ON after placing the total station at a predetermined measuring point. Consequently, the ambient temperature of the LCD panel 81 corresponding to the environment in which the total station is set is measured by the temperature measuring portion 10 and is input to the CPU 18. The ambient temperature is in general identical to the peripheral atmospheric temperature of the LCD panel 81. Nevertheless, if the LCD panel 81 directly receives sunlight or if the internal circuit of the total station generates heat, the ambient temperature could be higher than the peripheral atmospheric temperature of the LCD panel 81.

The LCD drive voltage which makes it possible to indicate the indication data corresponding to the measured ambient temperature at a constant contrast is supplied to the LCD panel 81. Thus, the information can be indicated at a constant contrast, regardless of the environmental conditions of the total station including the temperature and the direction or intensity of the sunshine, etc.

The information demanding an operator to input items for the initialization or the survey mode, etc., is first indicated in the LCD panel 81. Upon demand, if the operator inputs the necessary items through the operation portion 7, the commencement of the surveying operation is indicated. When the data is input from the distance measuring portion 12 and/or the angle measuring portion 11 as a result of the surveying operation, the CPU 18 calculates the distance values and/or the angle values in accordance with the input data. The distance values and/or the angle values thus obtained are indicated in the LCD panel 81. If LCD panels 81 are provided on the front and rear surfaces of the total station, a possibility exists that there is a difference in the ambient temperature between the LCD panel which is located in sunlight and the LCD panel which is located in shadow. In this case, the temperature measuring portion 10 and the drive voltage generating portion 13 are provided for each LCD panel 81, so that the contrast of the indication in the front and rear LCD panels can be made identical.

In the illustrated embodiment, the temperature-voltage table 14 is used to obtain the LCD voltage based on the ambient temperature of the LCD panel 81. Alternatively, if the relationship between the ambient temperature and the LCD drive voltage necessary for a constant contrast is represented by an arithmetic function, the LCD drive voltage necessary to provide a constant contrast can be obtained using the arithmetic function in which the ambient temperature measured by the temperature measuring portion 10 is inserted.

Moreover, it is also possible for the temperature measuring portion 10 to be used as a temperature sensor which is adapted to input a correcting temperature for the calculation of the distance value.

As can be understood from the above discussion, according to the present invention, information can be indicated at a constant contrast regardless of the ambient temperature.

The LCD controller 84 periodically drives the drivers 82 and 83 by the indication data read in the indication RAM 85 at a standard cycle, e.g. 1/30 second.

The transmission or interception of light through the LCD panel 81 is controlled in accordance with a physical change in the orientation of the liquid crystal molecules, and hence it takes a predetermined period of time to complete the change in orientation of the liquid crystal molecules. This period of time will hereinafter be referred to as an "indication response speed (or time)". Since the indication response speed decreases as the temperature lowers, the indication response speed can be lower than the indication data renewal speed (cycle) at a low temperature. If this occurs, the indication data is renewed before the indication of the information, which is effected when the orientation of the liquid crystal molecules is completely changed based on the first indication data, is visually confirmed. Consequently, the orientation of the liquid crystal molecules is changed based on the second indication data before the information corresponding to the first indication data is visually confirmed. For instance, if the interval of renewal of the indication data is 0.5 seconds, and the indication response time at −20° C. is 1 second, the indication data is renewed before the information indicated on the LCD panel 81 is visually confirmed, and hence two dimmed images (pieces of information) overlap. Therefore, a user cannot sufficiently recognize the content of the indicated information.

In order to prevent the indication response time from being shorter than the renewal time, a heater can be provided on the LCD panel 81. However, in this solution, the service life of a battery of an instrument or device in which the LCD panel 81 is incorporated is considerably reduced. This problem is particularly serious in an apparatus such as the above-mentioned surveying instrument which is usually used outdoors where the possibility of a considerable change in temperature exists.

The second embodiment of the present invention is characterized in that even if there is a change in temperature in the area around the surveying apparatus, a user can certainly confirm the displayed information.

Figure 6:
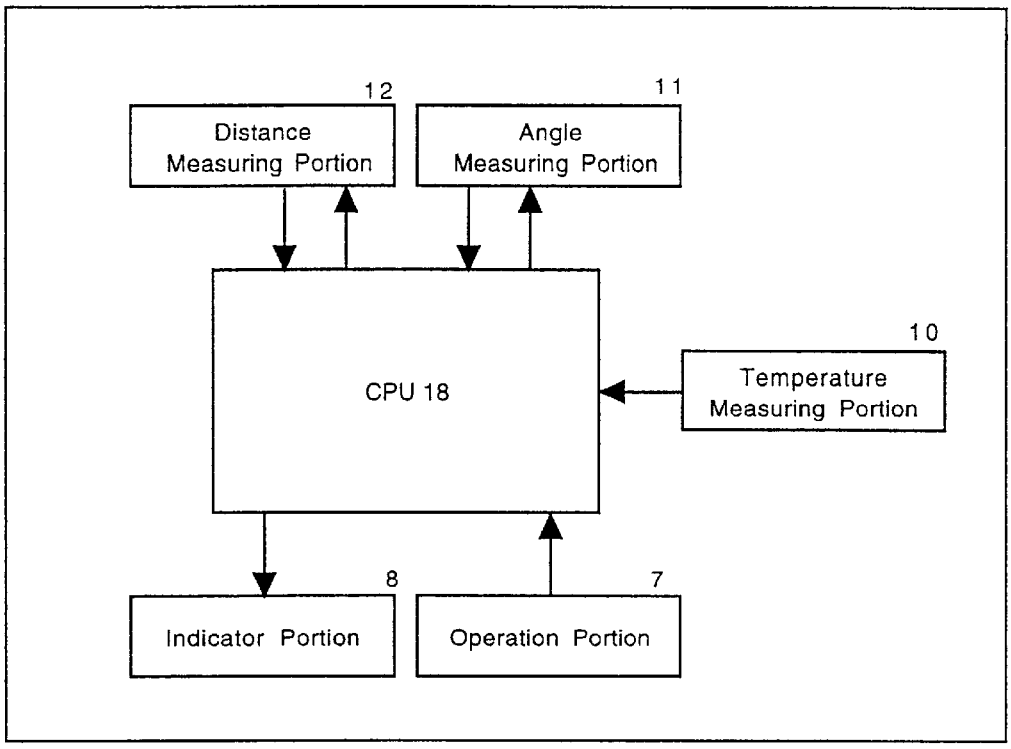
FIG. 6 is a block diagram of an internal circuit of the surveying apparatus shown in FIG. 1.

The internal structure of the total station according to a second embodiment of the present invention will be discussed below. In the block diagram shown in FIG. 6, the operation portion 7, the indication portion (display portion) 8, the temperature measuring portion 10, the angle measuring portion 11, and the distance measuring portion 12 are connected to the CPU (central processing unit) 18.

The CPU 18 performs the control programs to control the whole operation of the total station to thereby calculate the distance and angle in accordance with the phase difference data from the distance measuring portion 12 and the pulses from the angle measuring portion 11. The CPU 18 produces numerical indication data (distance data based on the distance value or angle data based on the angle value, etc.), in accordance with the indication commands of the various operations obtained by carrying out the control program or the calculated distance value or angle value. The indication data is stored in the internal RAM (shown in FIG. 3). If the ambient temperature measured by the temperature measuring portion 10 is equal to or above 0° C., the indication data is immediately sent to the indicator portion 8. If the ambient temperature measured by the temperature measuring portion 10 is below 0° C., the indication data is sent to the indicator portion 8 in one second. Thus, the information corresponding to the indication data is indicated in the indicator portion 8 (indication data renewal means). After the CPU 18 commands the indicator portion 8 to indicate the information based on the indication data, the CPU 18 produces new indication data and renews the indication data which has been stored in the internal RAM, based on new instructions for another operation or the measurements of a new distance value or angle value.

The structure of the indicator portion 8 is the same as the indicator portion 8 shown in FIG. 4.

<Control Operation>

The operation carried out by the CPU 18 to indicate the information on the LCD panel 81 of the indicator portion 8 will be discussed below with reference to the flow chart shown in FIG. 7.

Figure 7:
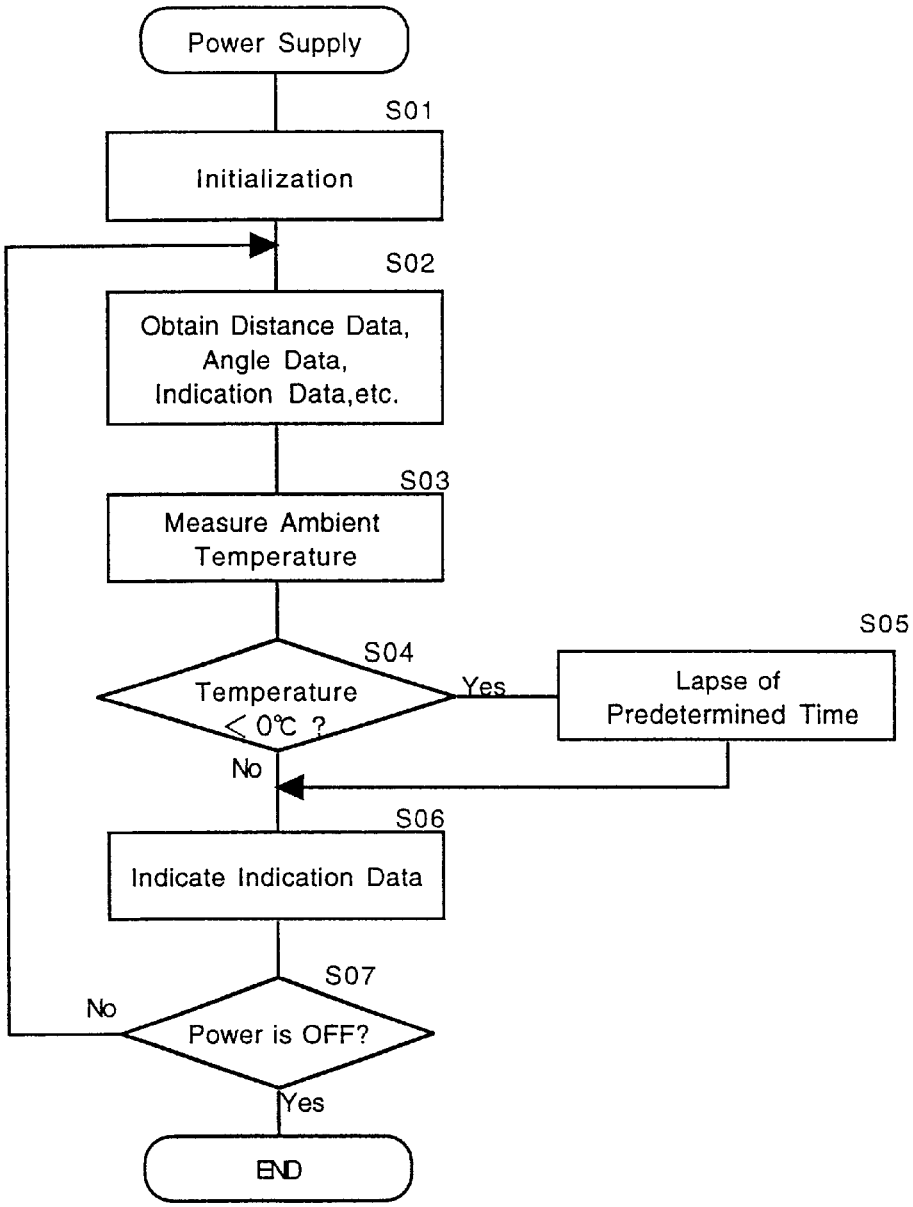
FIG. 7 is a flow chart showing a control operation carried out in a central processing unit shown in FIG. 6.

The operation shown in the flow chart in FIG. 7 commences when the power is supplied to the total station. The initialization operation is carried out at step S01. Thereafter, the CPU 18 produces the indication data and holds the same in the RAM at step S02. Namely, if there are operation instructions to be instructed to an operator, the CPU 18 produces the indication data for the operation instructions. If the phase difference data is input to the CPU 18 from the distance measuring portion 12, the CPU 18 calculates the distance value based on the phase difference data and produces the indication data (distance data) to indicate the operation instructions. If the pulses are input to the CPU 18 from the distance measuring portion 12, the CPU 18 calculates the angle value based on the pulses and produces the indication data (angle data) to indicate the angle value. Here, it is assumed that it takes approximately 0.5 sec., to produce the indication data.

The ambient temperature of the LCD panel 81, measured by the temperature measuring portion 10 is read by the CPU 18 at step S03. At step S04, whether the ambient temperature is above 0° C. is checked. If the ambient temperature is not more than 0° C., the control proceeds to step S06 after the lapse of a predetermined time (one second) at step S05. If the ambient temperature is equal to or above 0° C., the control proceeds to step S06 immediately.

Thereafter, at step S06, the CPU 18 transfers the indication data stored in the internal RAM to the indicator portion 8. Consequently, the LCD controller 84 writes the indication data in the indication RAM 85 and commences the indication of the information corresponding to the indication data as mentioned above.

Whether the power source of the total station is OFF is checked at step S07. If the power source is ON, the control is returned to step S02 to produce new indication data. If the power source is OFF, the control operation ends.

<Mode of Operation>

To measure the angle and distance using the total station constructed as above, an operator turns the power ON after placing the total station at a predetermined measuring point. As a result, the indication data to indicate information demanding an operator to input items for the initialization or the survey mode, etc., is produced by the CPU 18 and is stored in the internal RAM. The ambient temperature of the LCD panel 81, corresponding to the environment where the total station is positioned, is measured by the temperature measuring portion 10 and is input to the CPU 18. The indication data stored in the internal RAM of the CPU 18 is transferred to the indicator portion 8 immediately when the ambient temperature is equal to or above 0° C. , and in one second when the ambient temperature is less than 0° C., respectively, so that the indication of the information by the indicator portion 8 is commenced. Namely, the switching transistors of the LCD panel 81 are selectively actuated, so that the orientation of the liquid crystal molecules is varied in the indicator portion 8.

The CPU 18 produces new indication data (indication data to demand an operator to input the necessary instructions when the necessary operations are not input, or indication data to indicate the commencement of the survey operation when the necessary instructions are input, or indication data to indicate the distance value when the phase difference data is input from the distance measuring portion 12, or indication data to indicate an angle value when the pulses are input from the angle measuring portion 11) during the indication of the indication data by the indicator portion 8 (i.e., during the changing of the orientation of the liquid crystal molecules) and renews the indication data stored in the internal RAM. If the ambient temperature is equal to or above 0° C., the new indication data is sent to the indicator portion 8 immediately. However, at this ambient temperature, the change of the orientation of the liquid crystal molecules based on the previous indication data has been completed within the predetermined period of time (0.5 sec.) for renewal of the indication data in the internal RAM of the CPU 18. Accordingly, the operator can recognize the information based on the previous indication data even if the new indication data is transferred to the indicator portion 8.

If the ambient temperature is below 0° C., the transfer of the new indication data to the indicator portion 8 occurs after the lapse of one second. Namely, the information based on the new indication data is indicated 1.5 seconds after the commencement of the indication of the information based on the previous indication data. Therefore, if the indication response time is one second, at an ambient temperature of −20° C. , the operator can certainly recognize the information based on the previous indication data within the remaining 0.5 seconds.

If 1.5 seconds has elapsed after the last indication data was transferred to the indicator portion 8, it is possible for the new indication data to be transferred to the indicator portion 8 immediately.

The temperature measuring portion 10 can be used also as a temperature sensor which inputs a correction value to correct the temperature in the calculation of the distance.

<Embodiment 3>

The third embodiment of the present invention is characterized in that the stand-by time in which no transfer of the indication data to the indicator portion 8 occurs is variable. In other words, the third embodiment of the present invention is characterized in that the interval time in which the indication data transfers from the internal RAM of the CPU 18 to the indication RAM 85 is variable.

<Structure>

Figure 8:
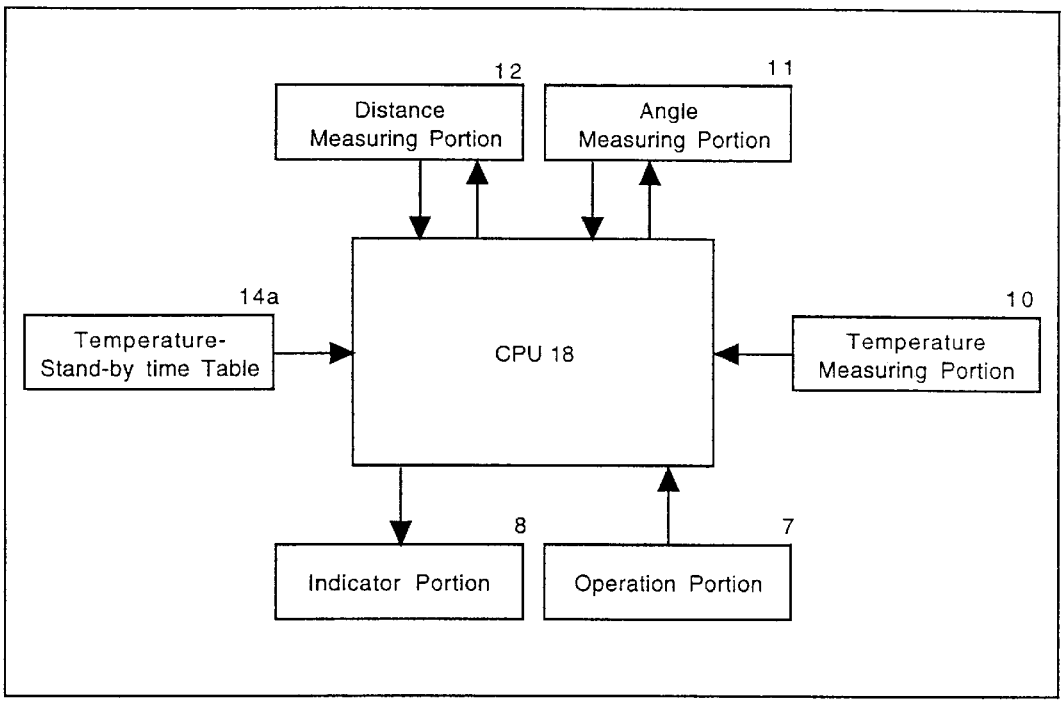
FIG. 8 is a block diagram of an internal circuit of a surveying apparatus according to a third embodiment of the present invention.

In FIG. 8 which shows a block diagram of the internal circuit of the total station according to the third embodiment, the temperature—stand-by time table 14*a* connected to the CPU 18 possesses addresses which are represented by the digital values of the ambient temperature of the LCD panel 81, and the corresponding stand-by time which is slightly longer than the indication response time is written as the stand-by time at the entries of the addresses (digital values). The relationship between the ambient temperature and the stand-by time shown in the temperature—stand-by time table 14*a* is set such that the stand-by time increases as the temperature decreases.

The CPU 18 reads the digital value of the ambient temperature of the LCD panel 81 measured by the temperature measuring portion 10, and then determines the corresponding stand-by time at the entry corresponding to the address represented by the digital value, referring to the temperature—stand-by time table 14*a*. The indication data is stored in the internal RAM. The indication data stored in the RAM is then transferred to the indicator portion 8 after the lapse of the read stand-by time.

<Control Operation>

The operation carried out by the CPU 18 to indicate the information on the LCD panel 81 of the indicator portion 8 will be discussed below with reference to the flow chart shown in FIG. 9.

Figure 9:
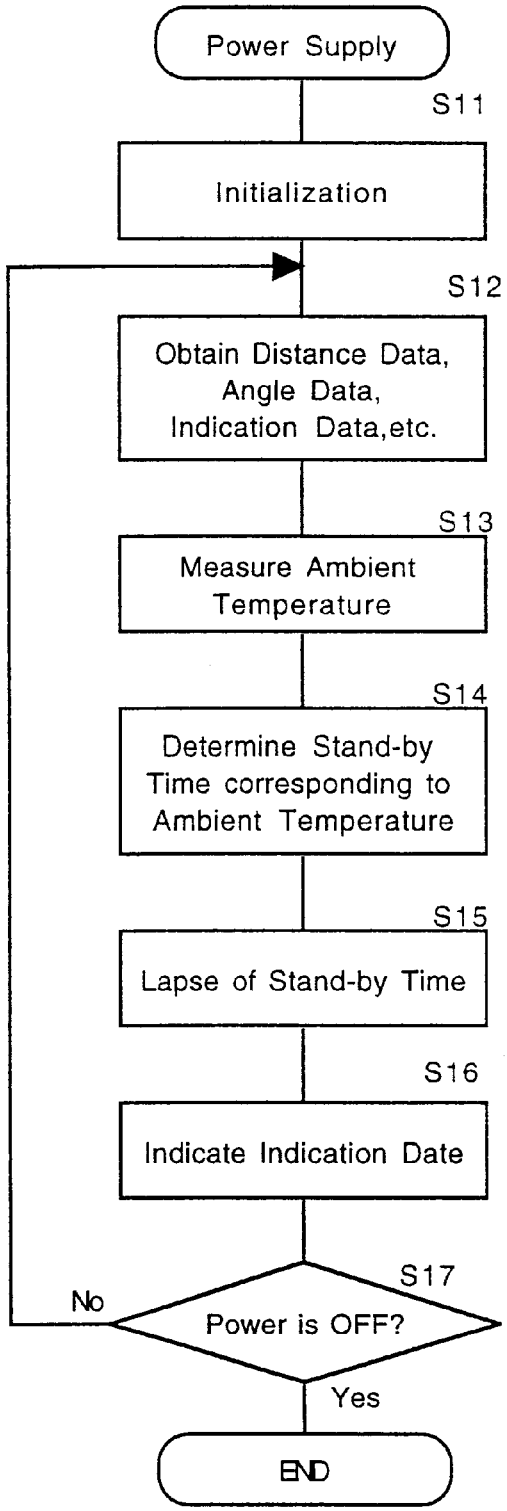
FIG. 9 is a flow chart of a control operation carried out in a central processing unit shown in FIG. 8.
Figure 10:
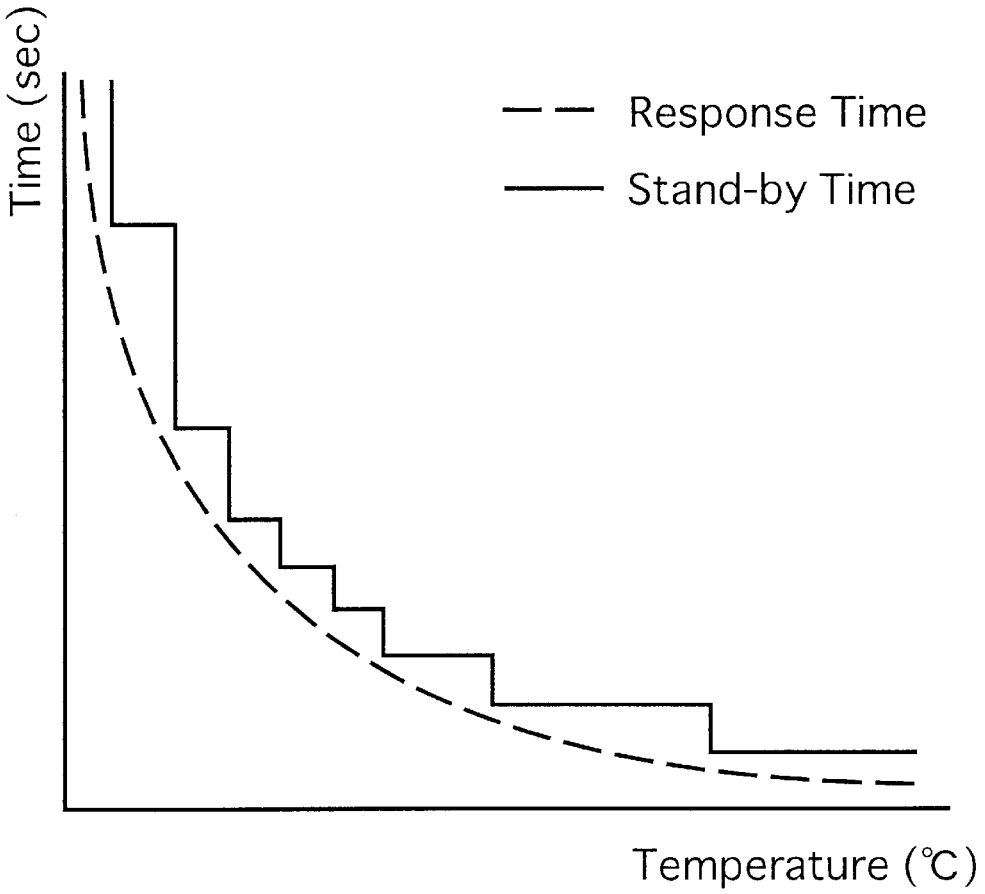
FIG. 10 is a graph which shows an example of a relationship between a stand-by time and a response time, each with respect to a measured temperature.

The operation shown in the flow chart in FIG. 9 commences when the power is supplied to the total station. The initialization operation is carried out at step S11. Thereafter, the CPU 18 produces the indication data and holds the same in the RAM at step S12.

The CPU 18 reads the ambient temperature measured by the temperature measuring portion 10 and converted to digital values by an A/D converter at step S13.

The temperature—stand-by time table 14*a* is retrieved using the digital value of the ambient temperature as an address to obtain the corresponding stand-by time written at the entry corresponding to the address at step S14.

The control proceeds to step S16 after the stand-by time obtained at step S14 lapses at step S15.

The indication data stored in the internal RAM is transferred to the indicator portion 8 by the CPU 18 at step S16. The indicator portion 8 commences the indication of the information corresponding to the indication data.

Whether the power source of the total station is OFF is checked at step S17. If the power source is ON, the control is returned to step S12 to produce new indication data. If the power source is OFF, the control operation ends.

<Mode of Operation>

In the third embodiment, an appropriate stand-by time which is slightly longer than the corresponding indication response time is preset in the temperature—stand-by time table 14*a* for each ambient temperature. Therefore, not only can the information be certainly indicated based on the indication data, regardless of the ambient temperature, but also it is possible to prevent the renewal interval of the indication data to be relatively longer than the indication response time, thus resulting in a good indication response.

In the third embodiment, the temperature—stand-by time table 14*a* is used to obtain the stand-by time based on the measured ambient temperature of the LCD panel 81. Alternatively, if the relationship between the ambient temperature and the stand-by time is represented by an arithmetic function, the stand-by time can be obtained by the calculation using the arithmetic function in which the ambient temperature measured by the temperature measuring portion 10 is inserted.

The remaining structure and operation of the third embodiment are identical to those in the first embodiment and so no explanation therefor will be given.

As can be understood from the above discussion, according to the present invention, the information based on the indication data can be certainly indicated regardless of the ambient temperature. Moreover, since no heater for the LCD is necessary in the present invention, not only can the number of components of the apparatus be reduced, but also the service life of the battery can be increased.

What is claimed is:

1. A liquid crystal display apparatus:

a liquid crystal panel, which displays indication information in an indication response time that varies with a temperature of said liquid crystal display panel;

an indication controller, comprising an indication controller memory, said indication controller controlling display of the indication information on said liquid crystal panel based on indication data stored in said indication controller memory;

a temperature measuring system that measures the temperature associated with said liquid crystal display panel; and an indication data renewal system, comprising an indication data memory, which stores periodically renewed indication data, and a stand-by time table, which contains predetermined stand-by times corresponding to a plurality of temperatures associated with said liquid crystal display panel, said predetermined stand-by times being longer than the indication response time of said liquid crystal display panel at each of the plurality of temperatures;

wherein said indication data renewal system determines a stand-by time from said stand-by time table, based on the temperature measured by said temperature measuring system, and varies a time period in which the periodically renewed indication data stored in said indication data memory is transferred to said indication controller memory for display on said liquid crystal panel.

2. The liquid crystal display apparatus according to claim 1, wherein said indication controller maintains display of indicated data on said liquid crystal panel until said indication controller receives said renewed indication data.

3. The liquid crystal display apparatus according to claim 1, wherein the temperature associated with said liquid crystal panel is the temperature of said liquid crystal panel.

4. The liquid crystal display apparatus according to claim 1, wherein the temperature associated with said liquid crystal panel is the ambient temperature of said liquid crystal panel.

5. The liquid crystal display apparatus according to claim 1, wherein the indication response time increases as the temperature associated with said liquid crystal panel decreases.

6. The liquid crystal display apparatus according to claim 1, wherein said indication data renewal system transfers the renewed indication data to said indication controller memory immediately when the temperature associated with said liquid crystal display panel is at or above a predetermined threshold value and after the stand-by time has elapsed when the temperature associated with said liquid crystal display panel is below the predetermined threshold value.

7. The liquid crystal display apparatus according to claim 1, wherein said indication data renewal system transfers the renewed indication data to said indication controller memory at a standard interval time when the temperature associated with said liquid crystal display panel is at or above a predetermined threshold value and after the stand-by time, longer than the standard interval time, when the temperature associated with said liquid crystal display panel is below the predetermined threshold value.

8. The liquid crystal display apparatus according to claim 1, wherein said stand-by time table contains addresses represented by digital values of the temperature associated with said liquid crystal display panel, so that the stand-by times are stored as entries corresponding to said addresses.

9. The liquid crystal display apparatus according to claim 1, wherein said liquid crystal display panel, said temperature measuring system and said indication data renewal system are utilized in a surveying instrument.

10. A liquid crystal display apparatus comprising:

a liquid crystal panel, which displays indication information in an indication response time that varies with a temperature associated with said liquid crystal display panel;

an indication controller, comprising an indication controller memory, said indication controller controlling display of the indication information on said liquid crystal panel based on indication data stored in said indication controller memory;

a temperature measuring system that measures the temperature of said liquid crystal display panel; and an indication data renewal system, comprising an indication data memory, which stores periodically renewed indication data, and a data processor, which calculates a stand-by time corresponding to the temperature associated with said liquid crystal display panel, the calculated stand-by time being longer than the indication response time of said liquid crystal display panel at the temperature;

wherein said indication data renewal system determines a stand-by time from said data processor, based on the temperature measured by said temperature measuring system, and varies a time period in which the periodically renewed indication data stored in said indication data memory is transferred to said indication controller memory for display on said liquid crystal panel.

11. The liquid crystal display apparatus according to claim 10, wherein said indication controller maintains display of indicated data on said liquid crystal panel until said indication controller receives the renewed indication data.

12. The liquid crystal display apparatus according to claim 10, wherein the temperature associated with said liquid crystal panel is the temperature of said liquid crystal panel.

13. The liquid crystal display apparatus according to claim 10, wherein the temperature associated with said liquid crystal panel is the ambient temperature of said liquid crystal panel.

14. The liquid crystal display apparatus according to claim 10, wherein the indication response time increases as the temperature associated with said liquid crystal panel decreases.

15. The liquid crystal display apparatus according to claim 10, wherein said indication data renewal system transfers the renewed indication data to said indication controller memory immediately when the temperature of said liquid crystal display panel is at or above a predetermined threshold value and after the stand-by time has elapsed when the temperature associated with said liquid crystal display panel is below the predetermined threshold value.

16. The liquid crystal display apparatus according to claim 10, wherein said indication data renewal system transfers the renewed indication data to said indication controller memory at a standard interval time when the temperature associated with said liquid crystal display panel is at or above a predetermined threshold value and after the stand-by time, longer than said standard interval time, when the temperature associated with said liquid crystal display panel is below the predetermined threshold value.

17. The liquid crystal display apparatus according to claim 10, wherein said liquid crystal display panel, said temperature measuring system and said indication data renewal system are utilized in a surveying instrument.

* * * * *